US007531762B2

(12) United States Patent
Flegel

(10) Patent No.: US 7,531,762 B2
(45) Date of Patent: May 12, 2009

(54) ELECTRICAL PANEL INPUT INTERLOCK ASSEMBLY

(75) Inventor: Michael O. Flegel, Racine, WI (US)

(73) Assignee: Reliance Controls Corporation, Racine, WI (US)

( * ) Notice: Subject to any disclaimer, the term of this patent is extended or adjusted under 35 U.S.C. 154(b) by 161 days.

(21) Appl. No.: 11/759,063

(22) Filed: Jun. 6, 2007

(65) Prior Publication Data

US 2007/0278071 A1 Dec. 6, 2007

Related U.S. Application Data

(60) Provisional application No. 60/804,016, filed on Jun. 6, 2006.

(51) Int. Cl.
*H01H 9/26* (2006.01)

(52) U.S. Cl. ..... 200/50.32; 200/50.33

(58) Field of Classification Search ..... 200/50.32, 200/50.33, 50.37, 50.38, 50.39, 50.4; 361/600–602, 361/622, 627, 628, 631, 632, 634, 641, 643
See application file for complete search history.

(56) References Cited

U.S. PATENT DOCUMENTS 4,270,031 A * 5/1981 Borona et al. ..... 200/50.33
5,204,803 A 4/1993 Runge
5,648,646 A 7/1997 Flegel
5,805,414 A 9/1998 Feldhaeusser
5,835,341 A 11/1998 Rhodes et al.
6,031,193 A 2/2000 Flegel
6,096,986 A 8/2000 Flegel
6,184,595 B1 2/2001 Flegel
6,521,849 B1 2/2003 Flegel
6,621,689 B1 * 9/2003 Flegel ..... 361/631
6,927,349 B1 8/2005 Flegel et al.
7,402,766 B1 * 7/2008 Jonas et al. ..... 200/50.33
7,446,270 B2 * 11/2008 Somalingayya et al. .. 200/50.32

OTHER PUBLICATIONS

"Main Lugs Generator Panel", Schneider Electric, www.Schneider-electric.ca/www/en/products/stab-lok/html/lugsgenerator.htm, Mar. 26, 2004, 3 pages.

* cited by examiner

*Primary Examiner*—Michael A Friedhofer
(74) *Attorney, Agent, or Firm*—Boyle Fredrickson, S.C.

(57) ABSTRACT

A system and method of interlocking a plurality of electrical panel switches includes an interlock assembly having an interlock. The interlock has a first position that allows connection of one of utility power and power from an alternate power supply, such as a generator, to the electrical panel and prevents connection of the other of the utility power and generator power. The interlock has a second position that allows connection of the other of the utility power and generator power and prevents connection of one of the utility power and generator power to the electrical panel. The interlock also is constructed to control the positioning and sequence of operation of neutral connections between the power sources and the electrical panel.

15 Claims, 11 Drawing Sheets

ELECTRICAL PANEL INPUT INTERLOCK ASSEMBLY

CROSS-REFERENCE TO RELATED APPLICATION

This application claims the benefit of U.S. Ser. No. 60/804,016, filed Jun. 6, 2006, the disclosure of which is incorporated herein by reference.

BACKGROUND OF THE INVENTION

The present invention relates generally to electrical panels and, more particularly, to a power supply or input interlock assembly constructed to electrically isolate different inputs connected to an electrical panel.

Electrical panels, breaker boxes, or load centers frequently include a main contactor, switch, or breaker, which electrically isolates a series of load breakers from a utility power input. Occasionally, such load panels are configured to receive another input power source, such as from a generator, to provide electrical power to the individual loads in the event of a utility power failure. During interruption of utility power, the generator supplies power to the load center, which the load center distributes to the selected or designated circuits of the building. Before activating the generator power supply, the main switch must be disconnected or turned "OFF" to prevent the generator power from back-feeding through the utility conductors. A user must manually configure the switches of the load center to electrically connect the generator power with the series of loads and electrically isolate the utility power from the generator power, and vice-versa. In order to maintain electrical isolation between the generator power input and the utility power input, the connection/disconnection of the utility power supply and generator power supply must be performed in a specific sequence to ensure electrical isolation of the respective input powers. An interlock system has been developed for carrying out this function, and is shown and described in Flegel U.S. Pat. No. 6,621,689 issued Sep. 16, 2003, the disclosure of which is hereby incorporated by reference. While the system shown in the '689 patent controls operation of a main power supply ON/OFF switch and an auxiliary power supply ON/OFF switch, it contains no provisions for controlling operation of neutral switches associated with the main and auxiliary power supplies.

When a bonded neutral generator is connected to the wiring system of a building, the grounding conductor and the neutral conductor are connected in two places within the system. This allows for the return of current back to the generator to flow on both the grounding conductor and on the neutral conductor. Having normal current flow on the grounding conductor limits the ability of the grounding conductor to perform its safety function, and is therefore undesirable. Switching the neutral conductor(s) when switching the power supply conductors prevents any neutral current from flowing on the grounding conductor. Furthermore, it is important to control the sequence of operation of the generator and utility neutral switches when switching between power sources, since supplying power to a device without a neutral may result in failure of the device due to an unpredictable voltage being supplied to the device. To prevent this occurrence, the switching sequence is as follows when switching from main utility power to generator power:

1. Turn off main power;
2. Turn off main neutral;
3. Turn on generator neutral;
4. Turn on generator power.

This sequence is reversed when switching from generator power to utility power.

For the above reasons, it is desirable to provide an input interlock assembly that ensures electrical isolation of the utility power and the generator power during a transfer of the input power from one source to another, and which controls the sequence of operation of neutral switches associated with the utility and generator power supplies.

SUMMARY OF THE INVENTION

The present invention is directed to a main power switch interlock assembly that prevents inadvertent simultaneous electrical connection of both a utility power input and an input from an alternate power supply, such as a generator, to a breaker panel, and controls actuation of utility and alternate power supply neutral switches.

A system and method of controlling operation of a plurality of electrical panel switches includes an assembly having an interlock. The interlock has a first position that allows power to be supplied to the electrical panel from one power source, such as utility power or an alternate power supply such as a generator, and prevents the supply of power to the electrical panel from the other power source. The interlock also includes a feature that controls movement of neutral switches associated with the alternate power supply and utility power inputs to ensure that the neutral connection of the alternate power supply is ON when the alternate power supply is activated, and that the alternate power supply neutral connection is OFF and the utility neutral is ON when the utility power supply is activated.

Various other features, objects and advantages of the present invention will be made apparent from the following detailed description of the drawing figures.

BRIEF DESCRIPTION OF THE DRAWINGS

The drawings illustrate one preferred embodiment presently contemplated for carrying out the present invention.

In the drawings:

FIG. 11 is an elevational view of the load center assembly shown in FIG. 10 with the switches and interlock assembly positioned such that alternate power is communicated to the load terminal bars and the utility neutral OFF and the alternate power supply neutral ON.

DETAILED DESCRIPTION OF THE PREFERRED EMBODIMENT

Figure 1:
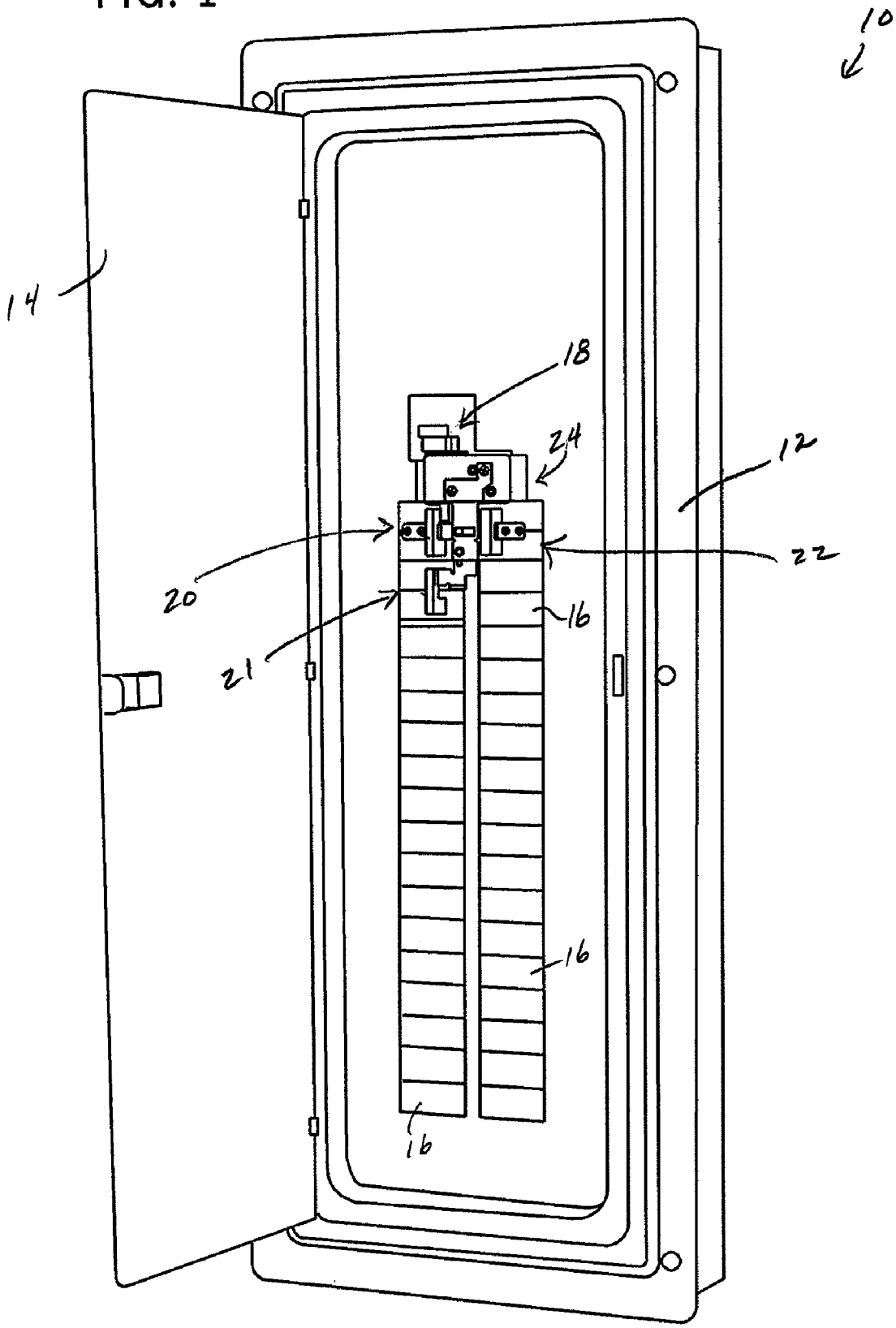
FIG. 1 is a perspective view of an exemplary load center assembly having one embodiment of an interlock assembly according to the present invention.

FIG. 1 shows a load center assembly 10 according to one embodiment of the present invention, which is configured to supply power to a series of electrical circuits from one of at least two power sources. Representatively, load center assembly 10 controls the supply of power to the electrical circuits from a primary power supply, such as utility power, and an alternate or secondary power source which is adapted to supply power in the event power from the primary power supply is unavailable. Typically, the alternate or secondary power source is an electrical generator, although it is understood that any other source of secondary or alternate power may be employed. The following description utilizes terminology which makes reference in various instances to a generator, and it is understood that such terminology is used for the sake the convenience and that the term "generator" is meant to encompass any secondary or alternate power source, and is not limited to a generator as the alternate power source.

Load center assembly 10 includes a cover 12 having a door 14 pivotably connected thereto. Cover 12 includes a series of knockouts 16 constructed to be removed as load breakers are added to load center assembly 10. A main switch 18 passes through cover 12 and is constructed to be connected to a utility power input. A generator neutral switch 20, generator switch 21, and a utility neutral switch 22 are constructed to be electrically connected to load center assembly 10. An interlock assembly 24 is connected to load center assembly 10 and prevents the inadvertent connection of the utility power input via main switch 18 and generator power input via generator switch 21 from being concurrently connected to a the load terminals of load center assembly 10. As will be explained, interlock assembly 24 also controls the movement of neutral switches 20 and 22 relative to main switch 18 and generator switch 21, to ensure that the switches are actuated in the correct sequence.

Figure 2:
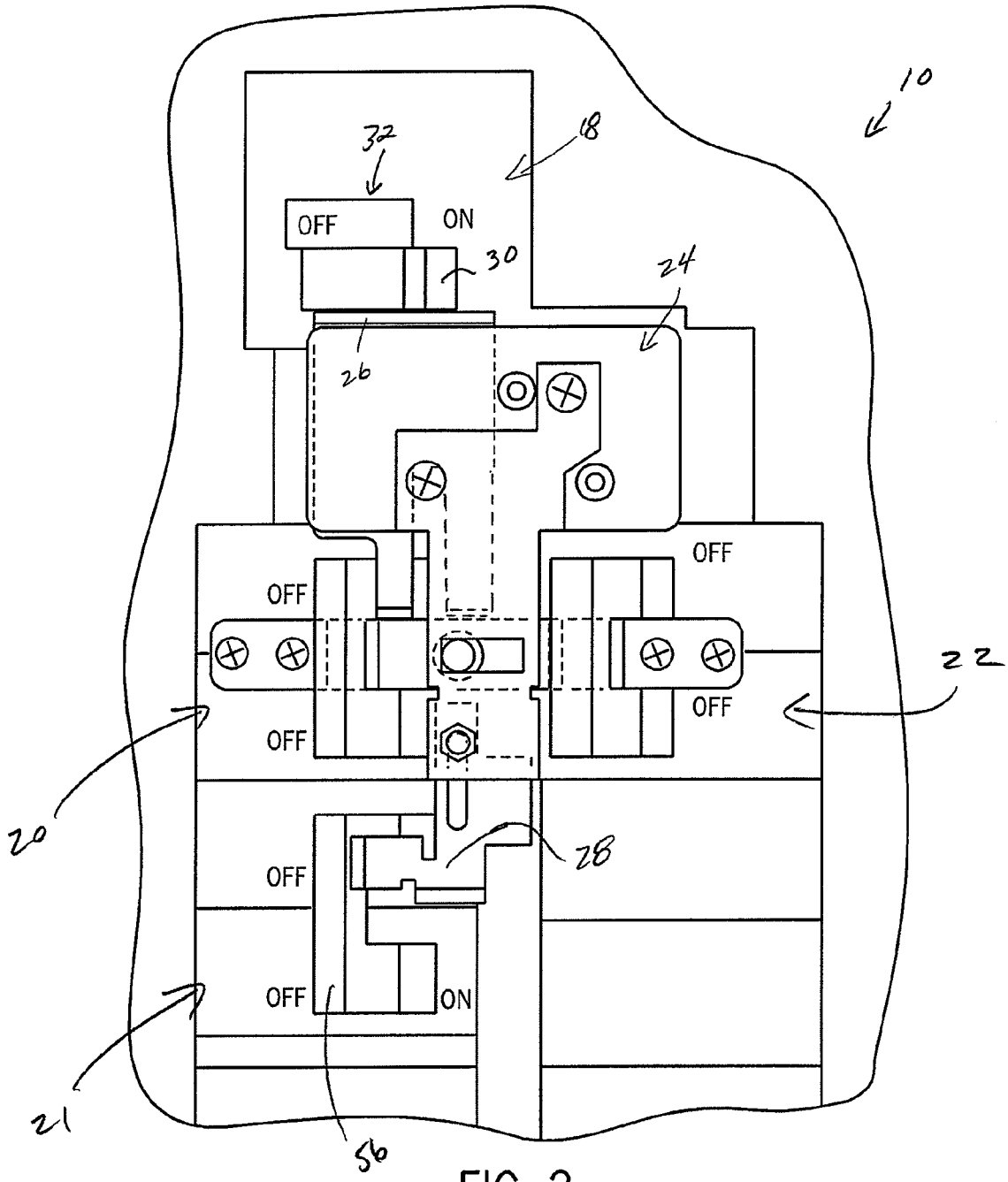
FIG. 2 is an elevational view of the load center assembly shown in FIG. 1 with the interlock assembly configured to enable the supply of utility power to the loads interconnected with the load center assembly.

FIG. 2 shows load center assembly 10 with interlock assembly 24 configured to enable the supply of utility power via main switch 18 such that the loads connected to load center assembly 10 are powered by utility power. Interlock assembly 24 is positioned to prevent the connection of generator power communicated via generator switch 21 to the load terminal bars of load center assembly 10, by preventing movement of generator switch 21 to the ON position. Interlock assembly 24 includes a first movable interlock 26 and a second movable interlock 28, the operation of which are described in FIGS. 2 through 7.

Figure 3:
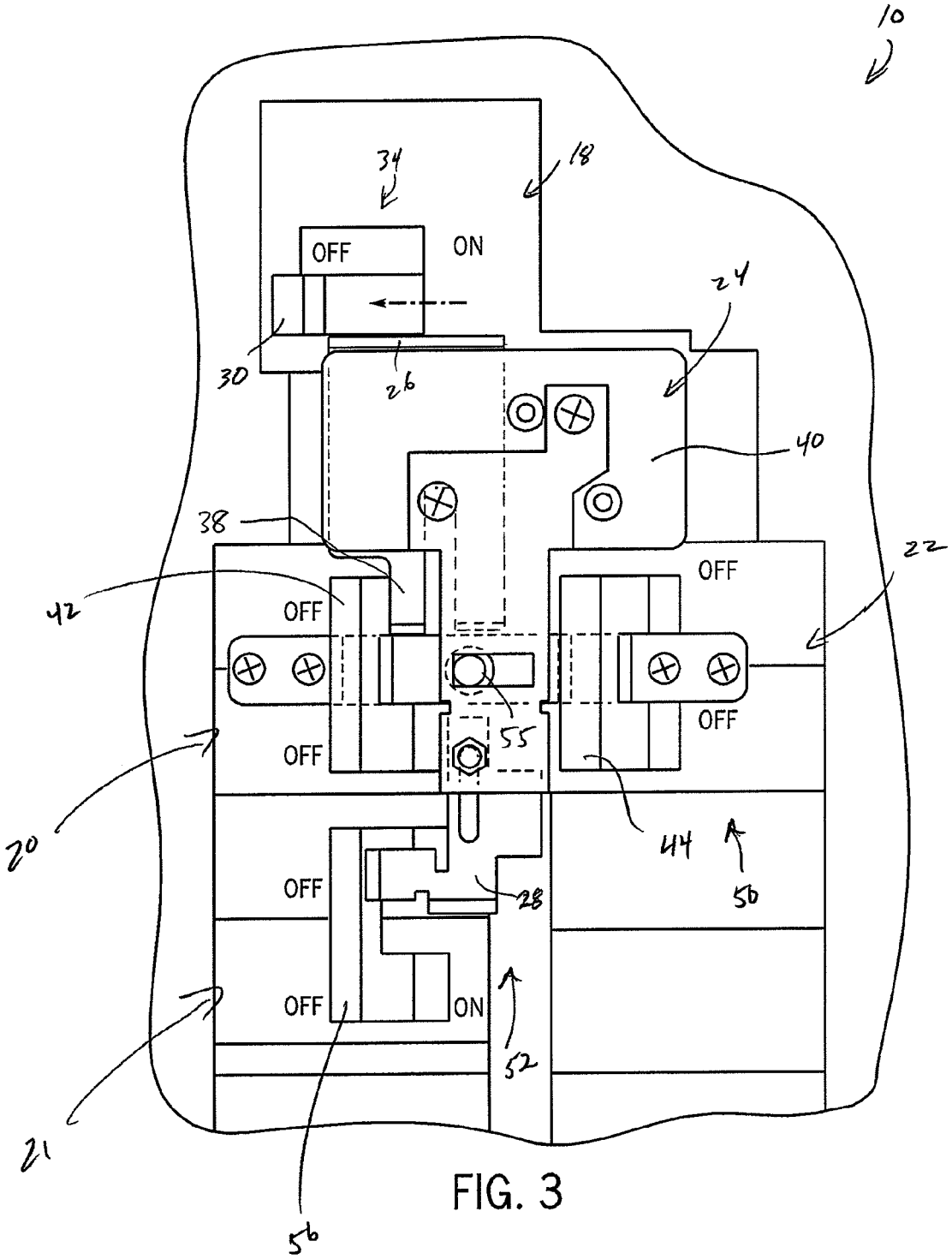
FIG. 3 is an elevational view of the load center assembly shown in FIG. 2 with the utility power and alternate power disconnected from the loads interconnected with the load center assembly.

Referring to FIG. 3, during interruption of utility power, a user translates switch handle 30 of main switch 18 from an ON position 32, as shown in FIG. 2, to the OFF position 34, as shown in FIG. 3. Such manipulation electrically isolates the load terminals and generator switch 21 from utility power conductors connected to main switch 18. With switch 18 positioned in OFF position 34, movable interlock 26 is manually translated upwardly in the direction of arrow 36 (shown in FIG. 4), thereby preventing movement of handle 30 away from the OFF position 34 and locking handle 30 OFF (shown in FIG. 4). A tab 38 of interlock 26 also moves in direction 36 and passes behind an interlock assembly retainer plate 40. Prior to movement of interlock 26 in direction 36, tab 38 extends into the throw of a switch handle 42 of generator neutral switch 20. Accordingly, prior to movement of interlock 26 in direction 36, tab 38 prevents the movement of generator neutral switch 20 away from the generator neutral OFF position. Because generator neutral switch handle 42 and the switch handle 44 of utility neutral switch 22 are interconnected for linear movement together by an in-line interlock assembly 46, tab 38 also prevents the movement of utility neutral switch 22 away from the utility neutral ON position.

Figure 4:
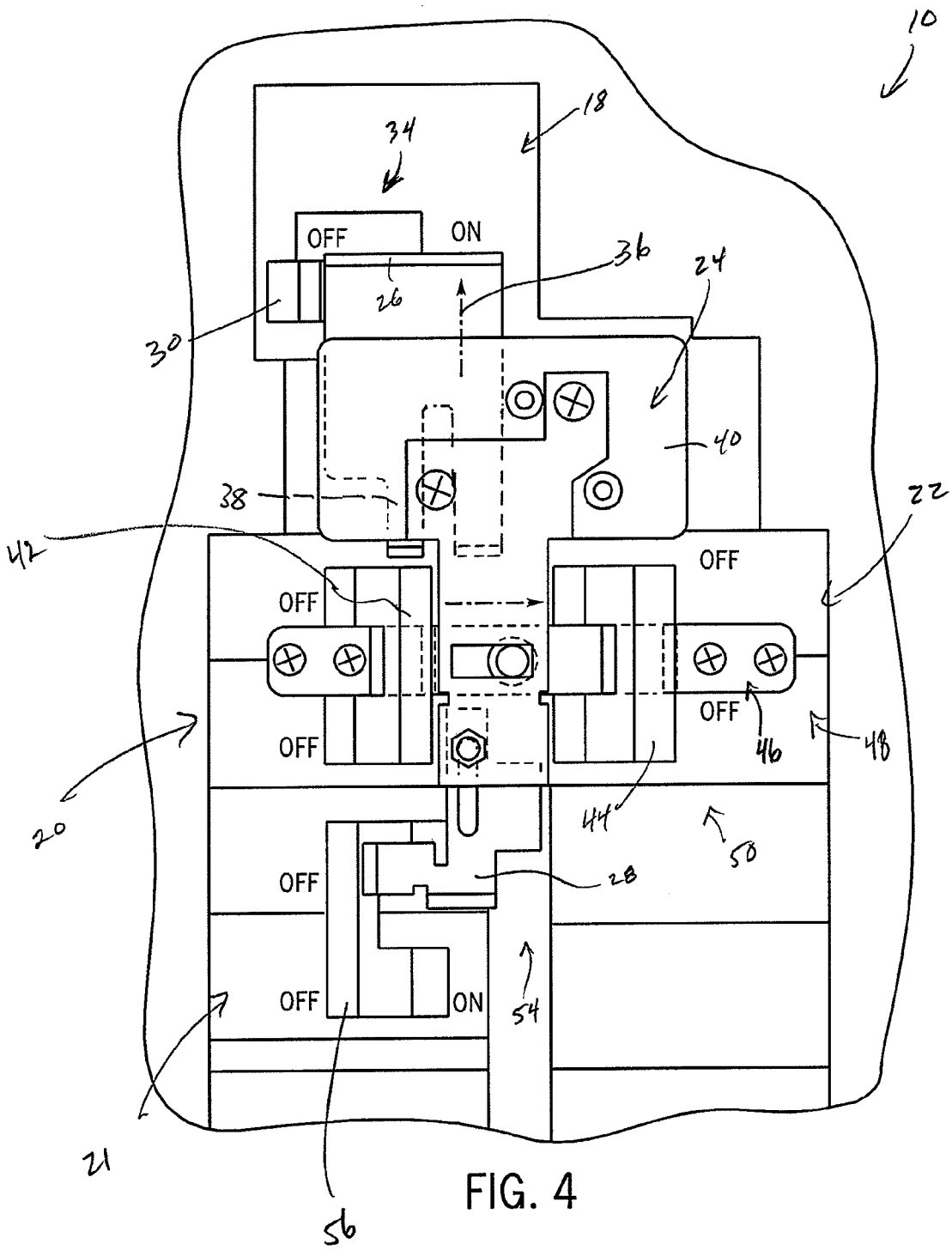
FIG. 4 is an elevational view of the load center assembly shown in FIG. 3 with the interlock assembly configured to enable a pair of neutral switches to switch OFF the utility neutral and switch ON the generator neutral.

As shown in FIG. 4, translation of interlock 26 in direction 36 relative to interlock assembly plate 40 obstructs handle 30 of main switch 18, thereby preventing utility power from being communicated to the load terminal bars of load center assembly 10. At the same time, tab 38 translates in direction 36 behind interlock assembly plate 40 and out of the way of the throw of handle 42 of generator neutral switch 20. Accordingly, when handle 30 of main switch 18 is located in OFF position 34, generator neutral switch 20 can be moved to the ON position by translation of handle 42. Due to the presence of in-line interlock assembly 46 between switch handle 42 and switch handle 44 of generator neutral switch 20 and utility neutral switch 22, respectively, generator neutral switch 20 is operable to an ON position and utility neutral switch 22 is moved to an OFF position, represented as position 48 as shown in FIG. 4. This connects the generator neutral to a neutral bar of load center assembly 10 common to switches 20 and 22.

Representatively, in-line interlock assembly 46 may have a construction as is shown and described in Flegel U.S. Pat. No. 6,031,193 issued Feb. 29, 2000 or Flegel U.S. Pat. No. 6,927,349 issued Aug. 9, 2005, the disclosures of which are hereby incorporated by reference.

Figure 5:
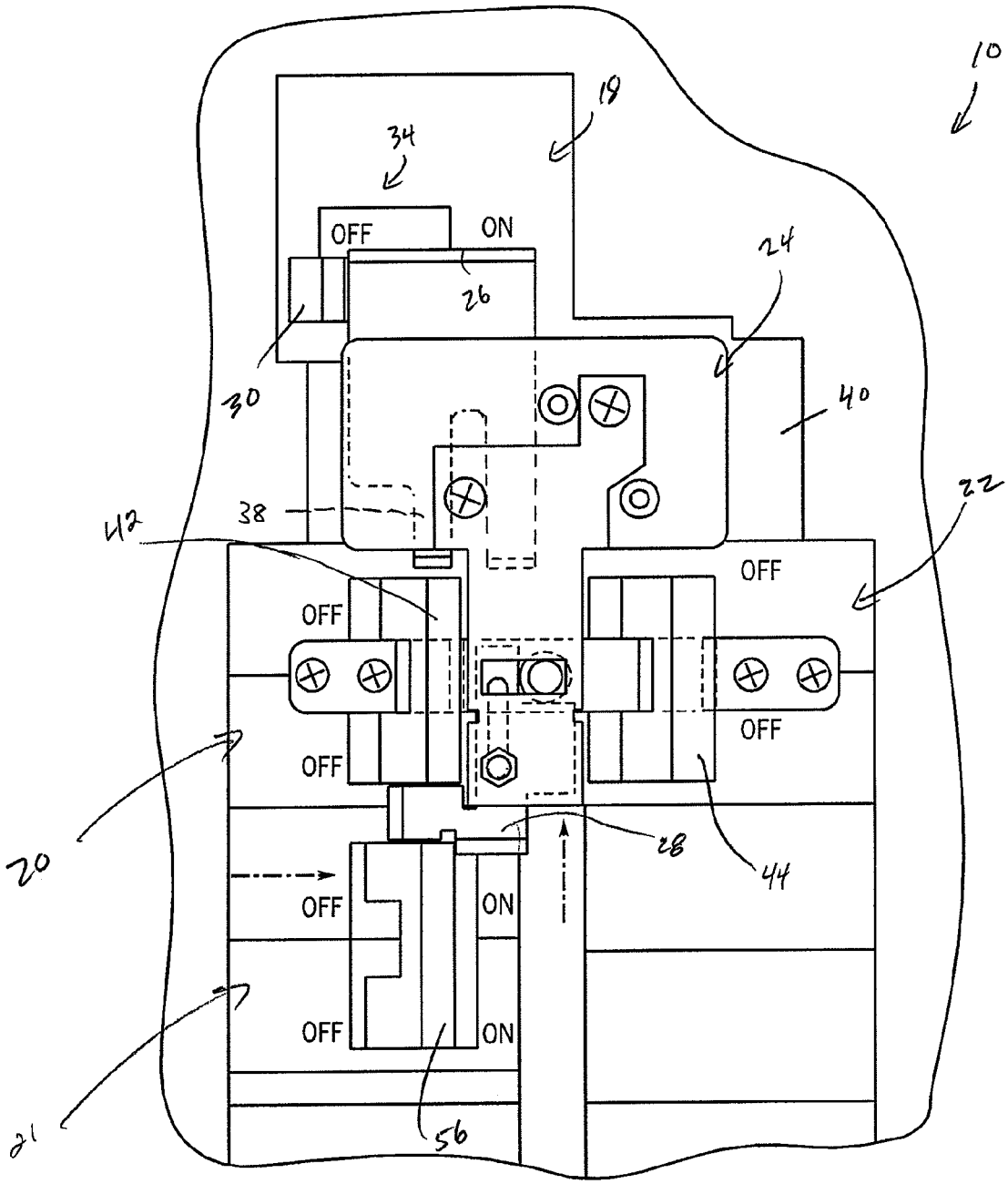
FIG. 5 is an elevational view of the load center assembly of FIG. 4 showing movement of a switch associated with the alternate power input connected to the loads interconnected with the load center assembly.

Referring to FIG. 3 and FIG. 4, second interlock 28 is movable from a first position 52, as shown in FIG. 3, to a second position 54, as shown in FIG. 4, when generator neutral switch handle 42 is in the ON position and utility neutral switch handle 44 is in the OFF position. As shown in FIG. 3, when second interlock 28 is located in first position 52, interlock 28 obstructs the operation of a switch handle 56 of generator switch 21. Also, interlock 28 is prevented from moving by a post 55 of interlock assembly 46. When second interlock 28 is allowed to be moved to second position 54 by the change in position of interlock assembly 46, as shown in FIG. 4, a switch handle 56 of generator switch 21 is operable to connect the generator power input to the input of load center assembly 10. Accordingly, when switch handles 30, 42, 44, and 56 are oriented in the positions as shown in FIG. 5, load center assembly 10 is electrically connected to a generator power input and electrically isolated from a utility power input, and the generator neutral is connected to the neutral of load center assembly 10. Furthermore, interlock assembly 24 prevents the reconfiguration of switches 18, 20, 22, and 21 to such an orientation wherein generator power and utility power are concurrently delivered to the load terminal bars of load center assembly 10. As such, interlock assembly 24 is constructed to sequence the operation of switches 18, 20, 22, and 21 and thereby control and segregate the input power delivered to the load terminal bars of load center assembly 10 relative to the neutral connections of the utility and generator power supplies.

Figure 6:
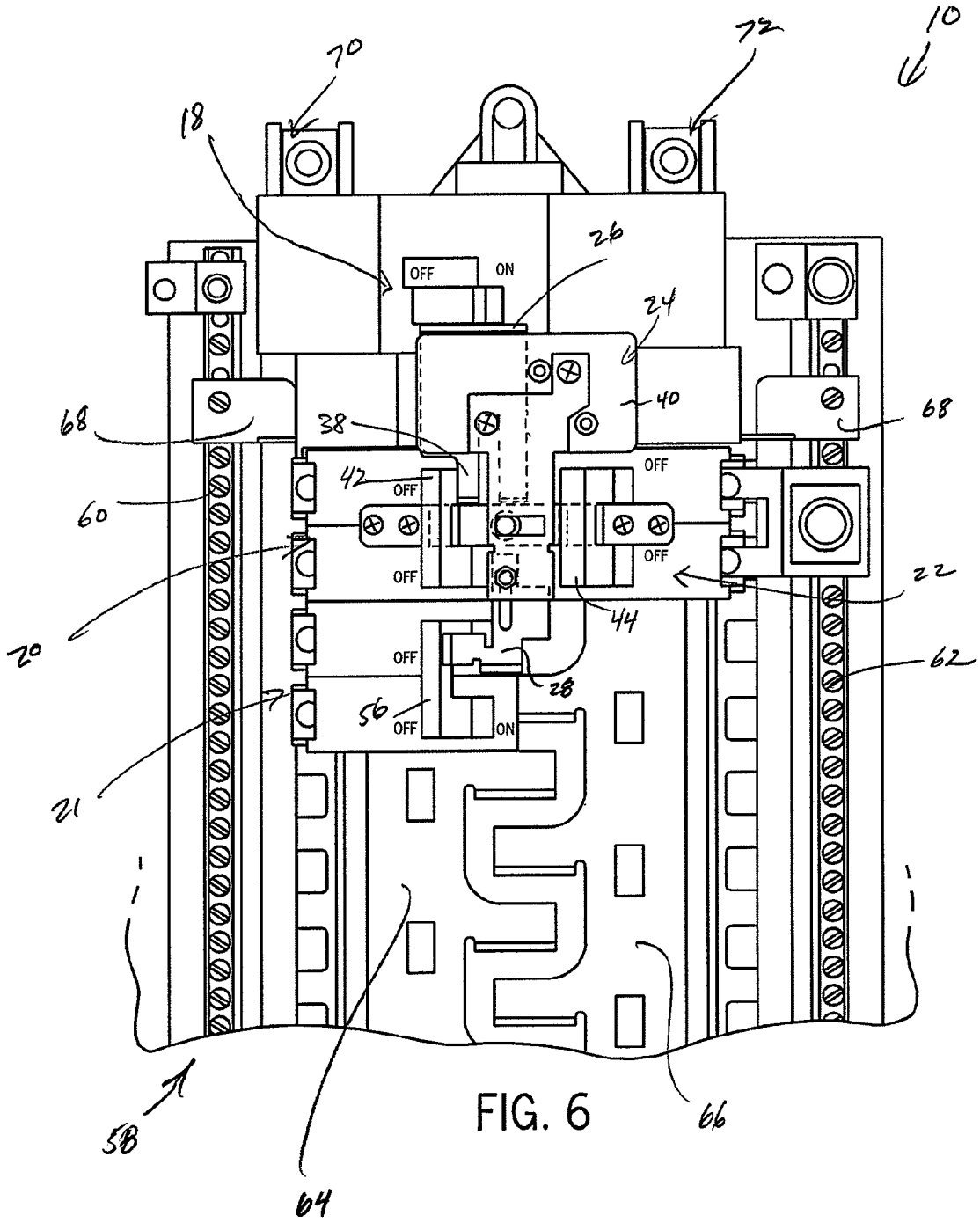
FIG. 6 shows the load center assembly of FIG. 1 with the cover removed therefrom.

As shown in FIG. 6, removal of cover 12 from load center assembly 10 exposes a series of terminal bars 58 located therebehind. Terminal bars 58 include a first and a second neutral bar 60, 62 and a first and a second hot lead terminal bar 64, 66, respectively. A neutral connector plate 68 extends behind interlock assembly 24 and electrically connects first neutral bar 60 and second neutral bar 62. Generator neutral switch 20 is electrically connected to neutral connector plate 68, as is utility neutral switch 22. Generator switch 21 is electrically connected to hot terminal bars 64 and 66.

Figure 7:
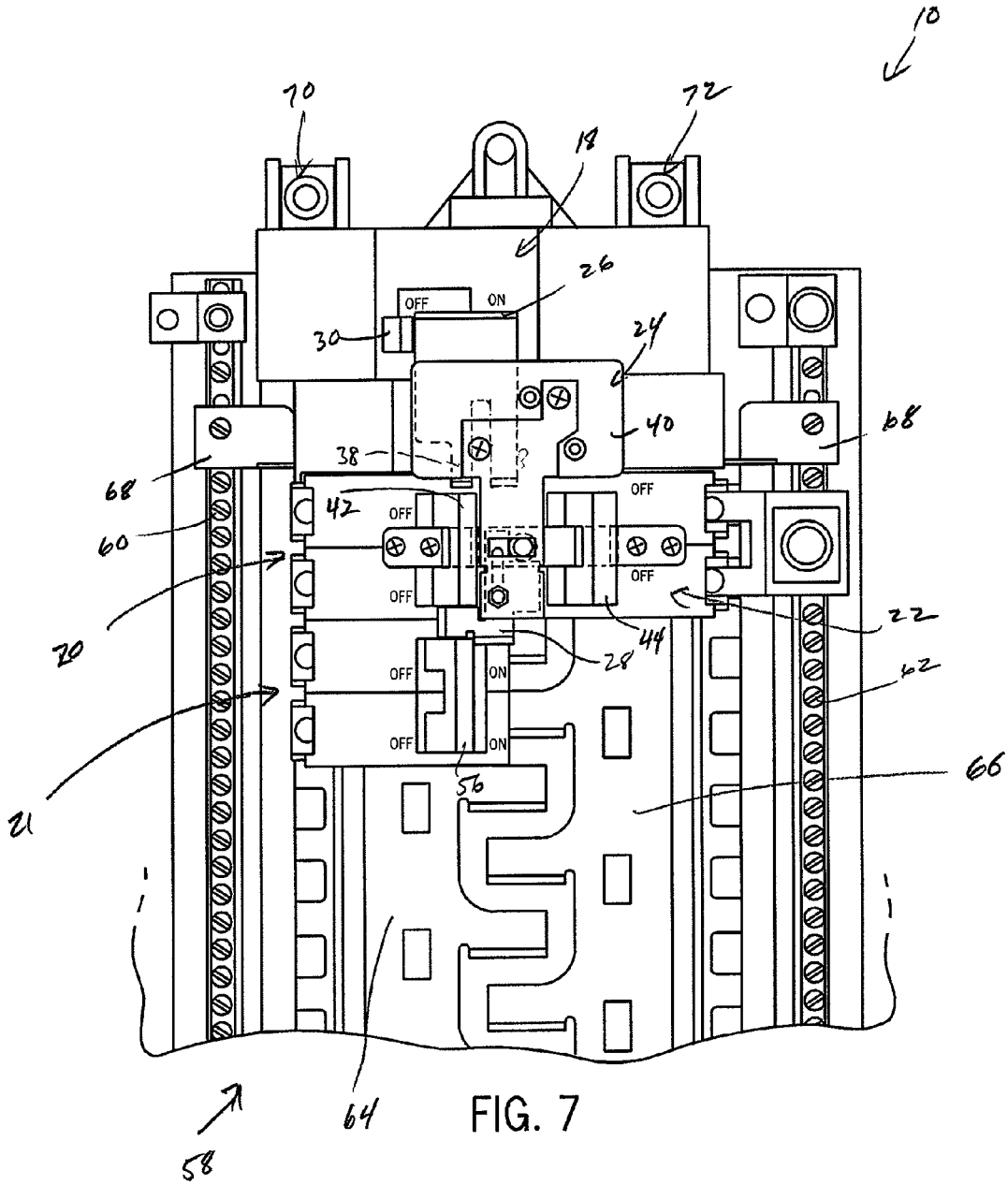
FIG. 7 shows the load center assembly of FIG. 1 with the switches positioned such that utility power is isolated from the load terminal bars and power from the alternate power supply is connected thereto.

Main switch 18 includes a first input terminal 70 and a second input terminal 72 constructed to be electrically connected to a utility power conductor connected to load center assembly 10. When switch handle 30 of main switch 18 is positioned in an ON position, as shown in FIG. 6, utility power communicated to input terminal 70 and input terminal 72 is communicated through main switch 18 to hot terminal bar 64 and hot terminal bar 66, thereby communicating utility power to the load breakers connected to load center assembly 10. Referring to FIG. 7, switch handle 30 of main switch 18 is moved to an OFF position, thereby electrically isolating input terminal 70 and input terminal 72 of main switch 18 from hot terminal bars 64, 66. Movement of first interlock 26 of interlock assembly 24 prevents switch handle 30 from being moved to an ON position and translates tab 38 of interlock assembly 24 such that switch handle 42 of generator neutral switch 20 is free to be moved to an ON position, which also results in movement of switch handle 44 of utility neutral switch 22 to an OFF position. Translation of second interlock 28 relative to interlock assembly 46 allows switch handle 56 of generator switch 21 to be moved to an ON position. In this manner, generator switch 21 is connected to hot terminal bars 64 and 66 and the generator neutral switch 20 is connected to neutral bars 60 and 62 via neutral connector plate 68. Accordingly, when switch handles 30, 42, 44, and 56 are oriented in the positions shown in FIG. 7, generator power is communicated through generator switch 21 to hot terminal bars 64, 66 and generator neutral is communicated through generator neutral switch 20 to neutral plate 68, thereby electrically connecting loads connected to either of first hot terminal bar 64 or second hot terminal bar 66 to the generator-provided input power associated with generator switch 21. This also isolates utility neutral from generator neutral and thus, the neutrals cannot be switched back unless generator and utility supply switches are both OFF. Generator power delivered to load center assembly 10 and communicated to hot terminal bar 64 and hot terminal bar 66 is electrically isolated from utility input terminals 70, 72 of main switch 18. Interlock assembly 24 prevents the concurrent electrical connection of generator switch 21 and main switch 18 with hot terminal bars 64, 66. Such a construction electrically isolates utility input terminals 70 and 72 from hot terminal bars 64, 66 when generator power is supplied, thereby preventing communication of generator-derived power beyond load center assembly 10 via utility conductors connected thereto.

Figure 8:
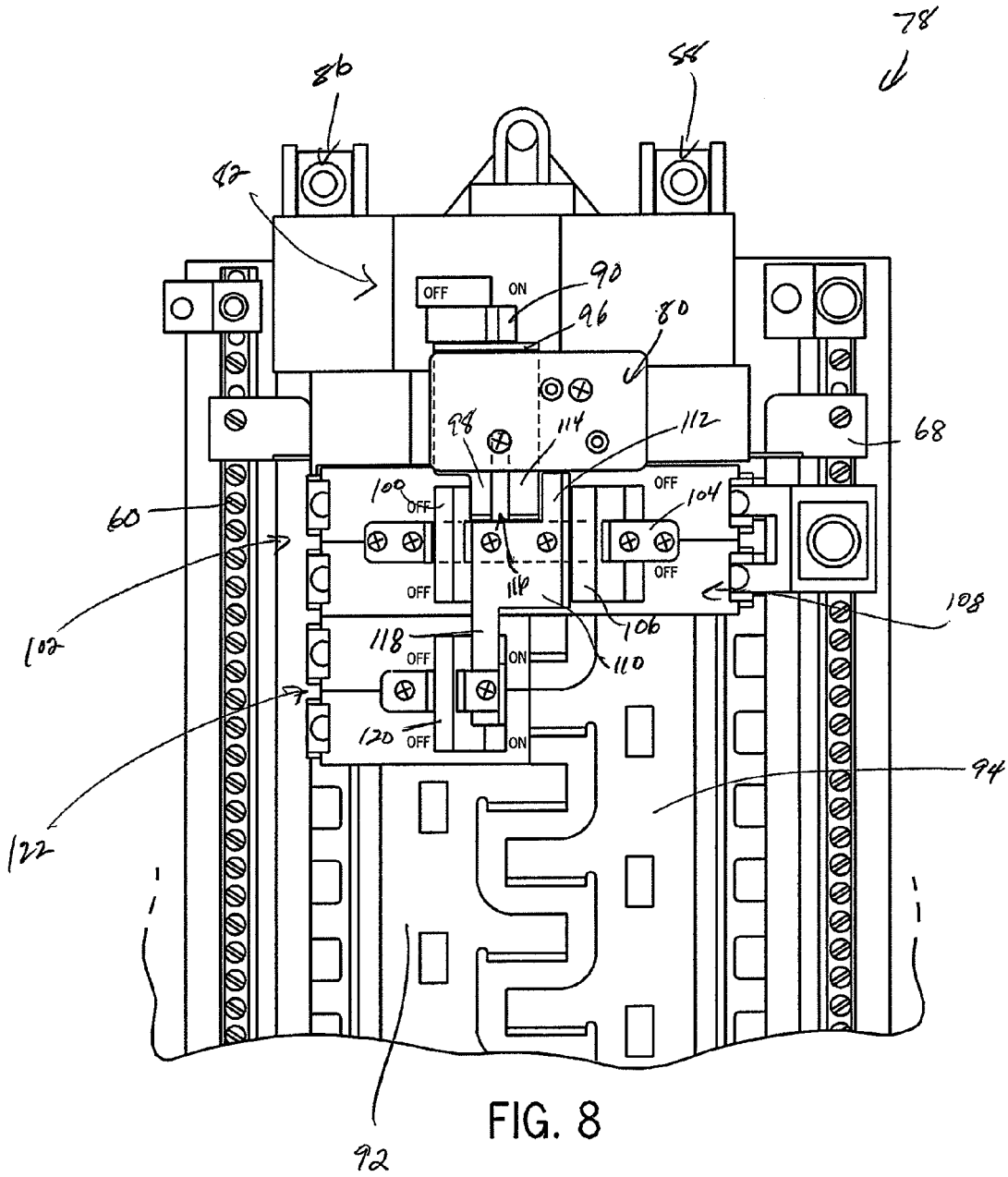
FIG. 8 is an elevational view of a load center assembly equipped with another embodiment of an interlock assembly according to the invention.

FIG. 8 shows another breaker box assembly or load center 78 according to another embodiment of the present invention. Load center 78 includes an alternate embodiment of an interlock assembly 80 according to the present invention. Interlock assembly 80 is disposed between a utility or main switch 82 and a series of switches mounted to load center 78. Main switch 82 includes a first input terminal 86 and a second input terminal 88 constructed to be electrically connected to utility power conductors, respectively. A switch 82 electrically connects input terminals 86, 88 with hot terminal bars 92, 94. Interlock assembly 80 includes a movable interlock 96 that has a tab 98 extending therefrom. Tab 98 extends into a throw of a switch handle 100 of generator neutral switch 102, thereby preventing movement of generator neutral switch handle 100 when tab 98 is so positioned.

An in-line interlock assembly 104 extends between generator neutral switch handle 100 and a switch handle 106 of a utility neutral switch 108 such that generator neutral switch handle 100 and utility neutral switch handle 106 are operatively associated such that neither switch can be independently moved. A bracket 110 is connected to connector assembly 104 and disposed between switch handle 100 and switch handle 106. Bracket 110 includes a first extension 112, which interferingly engages another tab 114 of interlock 96. First extension 112 and tab 114 are associated to allow movement of interlock 96 into a space 116 formed between first extension 112 and switch handle 100 of generator neutral switch 102. Such an orientation ensures a snug engagement therebetween, thereby preventing movement of switch handle 100 or switch handle 106 relative to interlock 96 when tabs 98, 114 are disposed in space 116.

Bracket 110 includes a second extension 118, which extends in a direction generally opposite the direction of extension of first extension 112. Second extension 118 is operatively connected to a switch handle 120 of a generator switch 122. Generator switch 122 is electrically connected to hot terminal bars 92, 94. Neutral switches 102 and 108 are electrically connected to neutral bar 60 and 62 via neutral connector plate 68. Accordingly, regardless of which side of load center 78 load circuits are connected, generator power can be utilized to power any desired load connected to load center 78.

Figure 9:
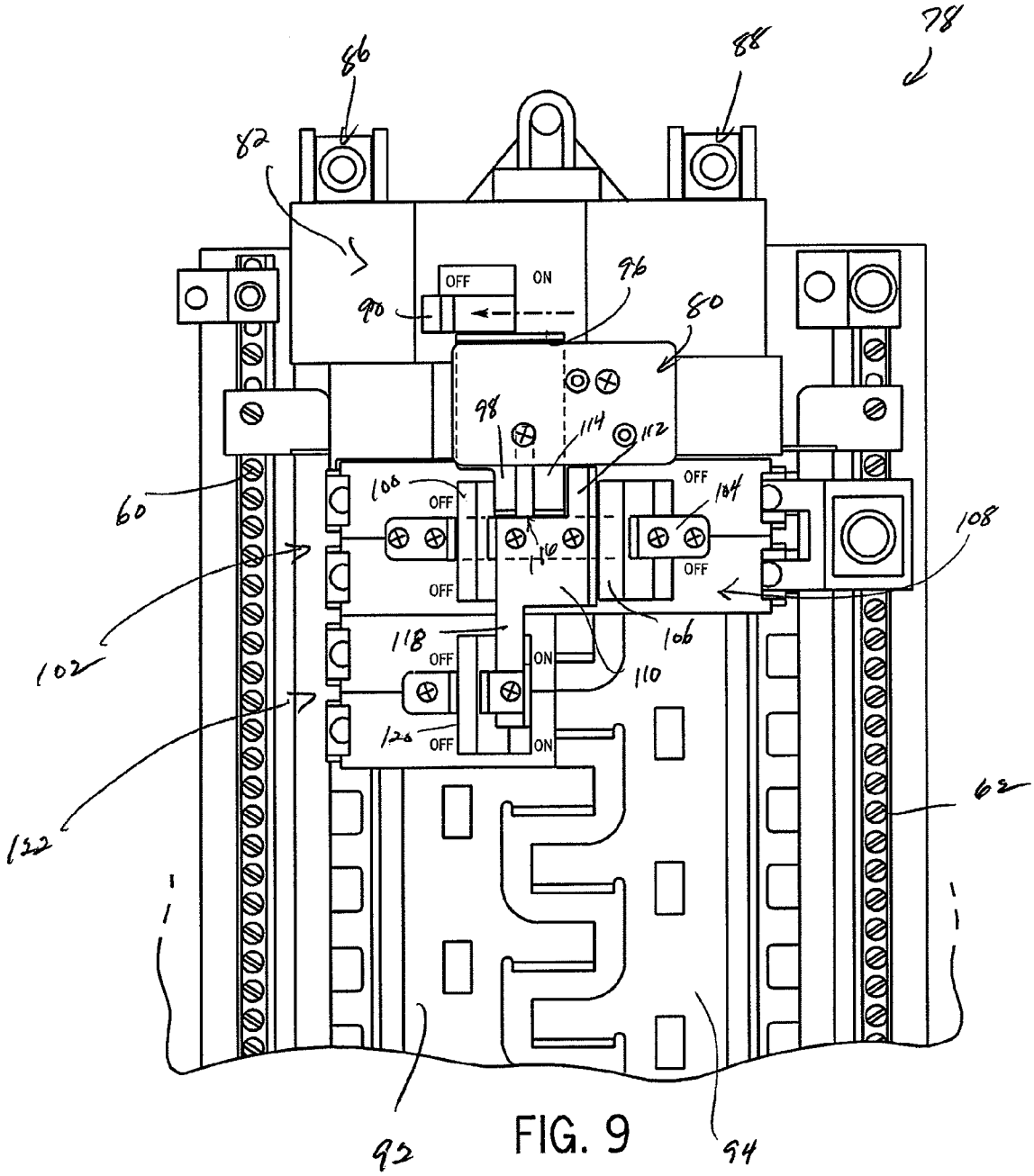
FIG. 9 is an elevational view of the load center assembly shown in FIG. 8 with the switches positioned such that utility power and power from the alternate power supply are both isolated from the load terminal bars and the utility neutral ON and the alternate power supply neutral OFF.

As shown in FIG. 9, switch handle 90 of main switch 82 is located in an OFF position, thereby electrically isolating hot terminal bars 92, 94 from the utility power connected to input terminals 86 and 88 of load center 78. Positioning of switch handle 90 in the OFF position allows interlock 96 to be moved in a direction, indicated by arrow 124 (shown in FIG. 10), toward switch handle 90. As interlock 96 moves in direction 124, tabs 98, 114 translate therewith and out of interfering engagement with switch handles 100, 106 and 120.

Figure 10:
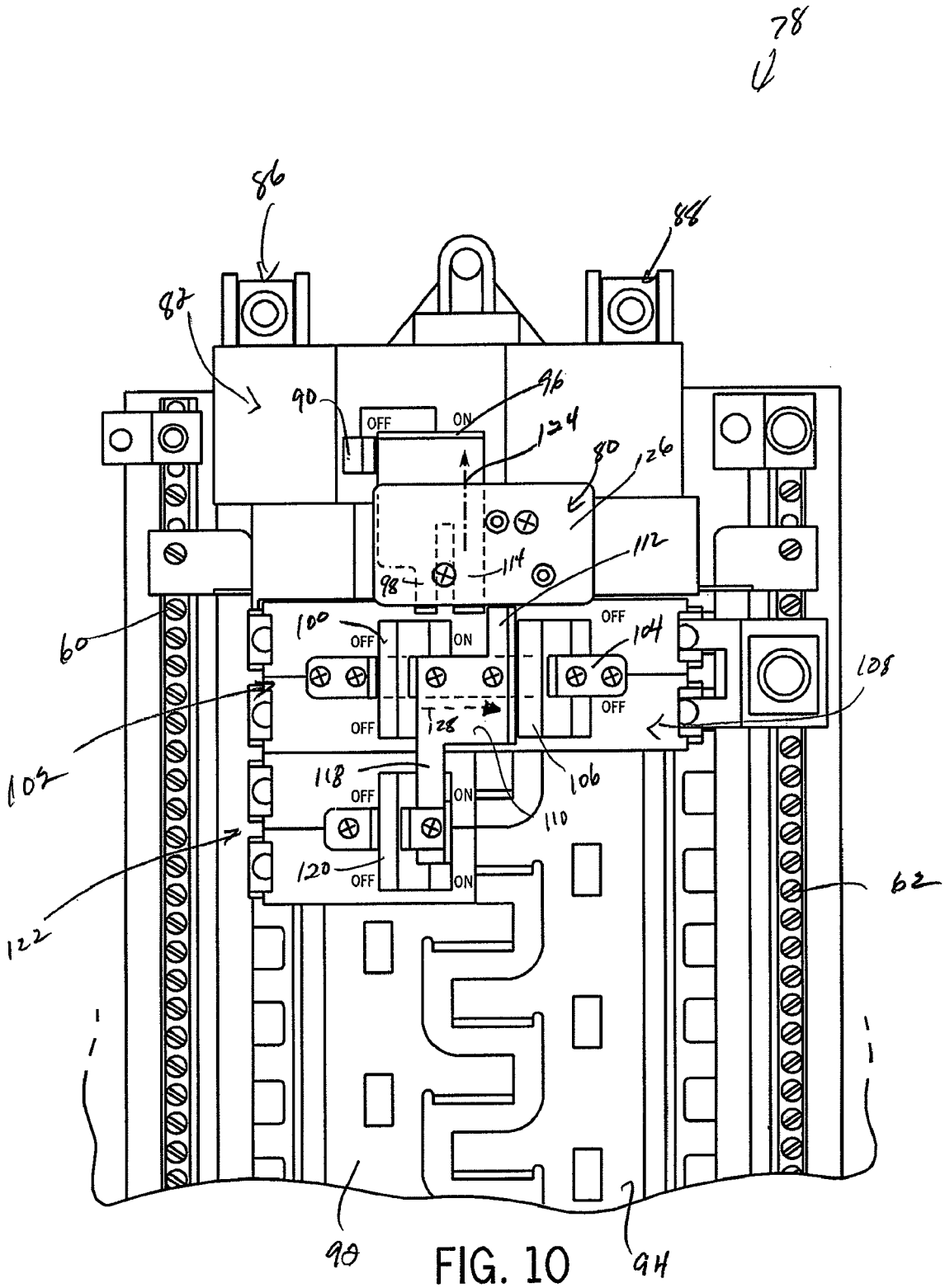
FIG. 10 is an elevational view of the load center assembly shown in FIG. 9 with the switches and interlock assembly configured to prevent connection of utility power to the load terminal bars and allow connection of alternate power thereto.

As shown in FIG. 10, when switch handle 90 is located in an OFF position and interlock 96 is displaced in direction 124, interlock 96 prevents switch handle 90 from being moved to the ON position. Accordingly, when interlock 96 is oriented in the position shown in FIG. 10, switch 82 is configured to electrically isolate the utility power input terminals 86, 88 from hot terminal bars 92, 94, thereby electrically isolating utility conductors connected to inputs 86, 88 from generator power communicated to hot terminal bars 92, 94. Furthermore, as shown in FIG. 10, when interlock 96 is positioned to obstruct handle 90, tabs 98, 114 translate in direction 124 and pass behind a cover plate 126 of interlock assembly 80. Switches handles 100, 106, 120 are interconnected via bracket 110 such that, when interlock 96 is translated in direction 124, as shown in FIG. 10, movement of any of switch handles 100, 106, 120 in a transverse direction, indicated by arrow 128, electrically connects generator input power from generator switch 122 to hot terminal bars 92, 94, respectively, and connects the generator neutral switch 102 to neutral bar 60. The connection of generator switch handle 120 to bracket 110 is positioned such that, as bracket 110 is translated laterally, the utility neutral switch handle 106 is first moved OFF and the generator neutral switch handle 100 is moved ON, before generator switch handle 120 is moved ON. Similarly, the generator switch handle is turned OFF before the generator neutral is switched OFF. This ensures proper sequence of operation of the switches as the supply of power from utility to generator is transferred.

Figure 11:
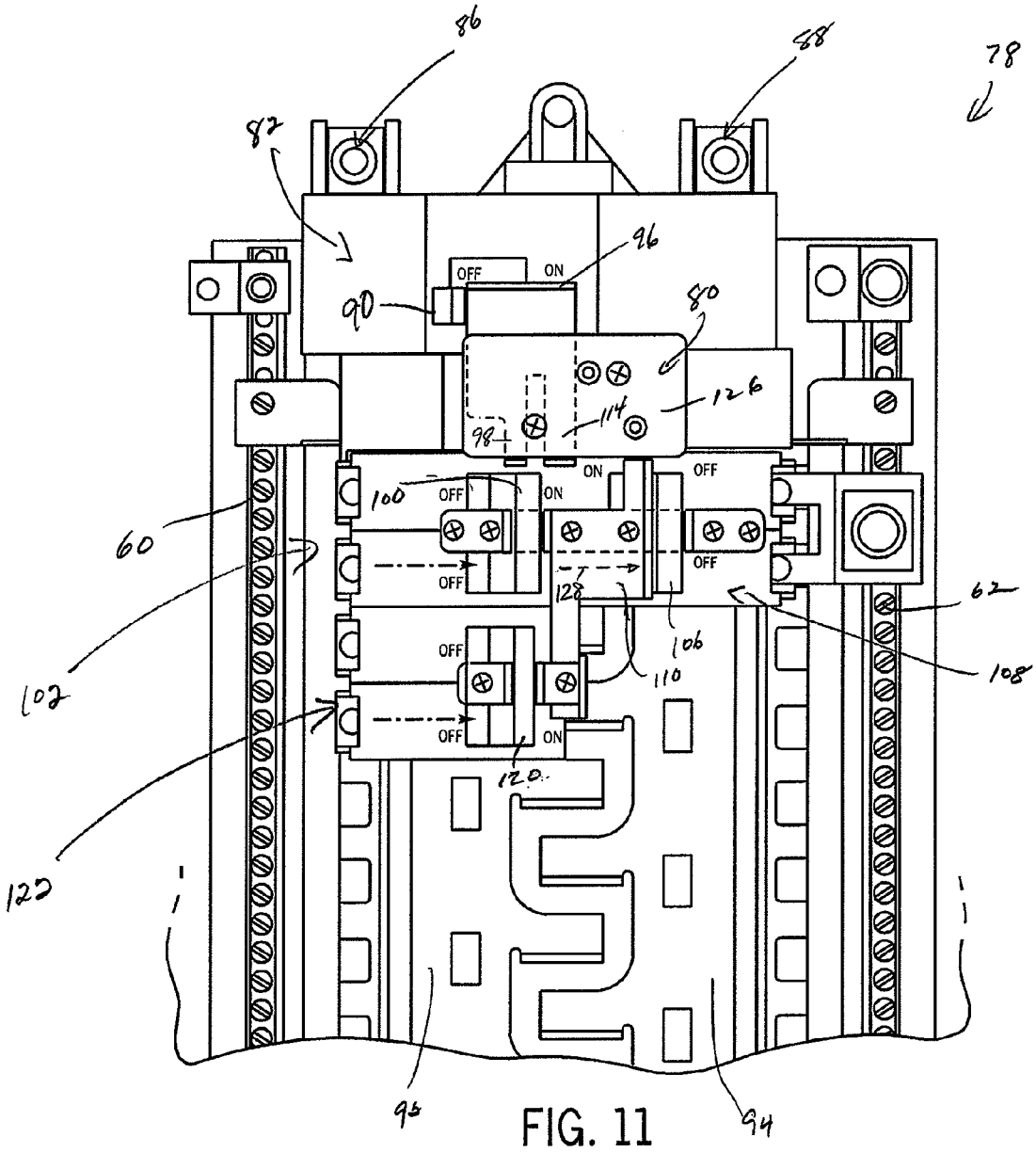

As shown in FIG. 11, bracket 110 has been translated in direction 128, thereby moving switch handles 100, 106, 120 to an ON position, and electrically connecting generator power communicated to generator switch 122 to hot terminal bars 92, 94 and connecting generator neutral switch 102 to neutral bars 60, 62. Furthermore, when generator power is communicated through generator switches 122 to hot terminal bars 92, 94, movable interlock 96 of interlock assembly 80 prevents the electrical connection of utility power input terminals 86, 88 of utility switch 82 with hot terminal bars 92, 94, thereby electrically isolating input terminals 86 and 88 from power communicated to load center 78 via the utility power source. Understandably, to convert load center 78 from utility-derived power to generator-derived power, a user must simply orient handle 90 of main switch 82 in the OFF position, translate interlock 96 in direction 124, and translate switch handles 100 and 120 to an ON position, thereby electrically connecting the generator-type power to hot terminal bars 92, 94 and the neutral to neutral bars 60, 62. Such a configuration allows a user to conveniently and expeditiously configure load center 78 to power desired loads from a desired input power supply.

A system and method of interlocking a plurality of electrical panel switches includes an interlock assembly having an interlock. The interlock has a first position that allows connection of one of utility power and generator power to the electrical panel and prevents connection of the other of the utility power and generator power. The interlock has a second position that allows connection of the other of the utility power and generator power and prevents connection of one of the utility power and generator power to the electrical panel.

Various alternatives are contemplated as being within the scope of the following claims particularly pointing out and distinctly claiming the subject matter regarded as the invention.

What is claimed is:

1. An electrical interlock assembly for controlling supply of electrical power from a utility power supply and an alternate power supply, comprising:

a mounting arrangement constructed to be fixed relative to a utility power switch and a power switch associated with the alternate power supply; and an interlock movably connected to the mounting arrangement and constructed to allow operation of one of the utility power switch and the alternate power supply switch and prevent operation of the other of the utility power switch and the alternate power supply switch, and wherein the interlock includes a neutral interlock for selectively enabling movement of two neutral switches, one neutral switch interconnected with the alternate power supply and another neutral switch interconnected with the utility power supply.

2. The electrical interlock assembly of claim 1 wherein the neutral interlock is movable between a first position and a second position, wherein when in the first position, the neutral interlock allows the utility power switch to be thrown and when in the second position, the neutral interlock prevents the utility power switch from being thrown.

3. The electrical interlock assembly of claim 2 wherein the first interlock, when in the first position, prevents the two neutral switches from being thrown and in the second position, allows the two neutral switches to be thrown.

4. The electrical interlock assembly of claim 1 wherein the neutral interlock is movable between a first position and a second position, wherein when in the first position, the neutral interlock prevents operation of the utility power switch and when in the second position, the neutral interlock allows operation of the alternate power supply switch.

5. The electrical interlock assembly of claim 4 wherein the neutral interlock is not movable to the second position unless the one neutral switch interconnected with the alternate power supply has been thrown to an ON position.

6. The electrical interlock assembly of claim 1 wherein the neutral interlock comprises an in-line interlock that moves the neutral switches in tandem.

7. The electrical interlock assembly of claim 1 wherein the neutral interlock is configured that connection of a load center from the utility power supply to the alternate power supply follows the following sequence:

(a) disconnection of the load center from a hot conductor of the utility power supply;

(b) disconnection of the load center from a neutral conductor of the utility power supply;

(c) connection of the load center to a neutral conductor of the alternate power supply; and (d) connection of the load center to a hot conductor of the alternate power supply.

8. The electrical interlock assembly of claim 7 wherein the neutral interlock is configured to ensure that reconnection of the load center from the alternate power supply to the utility power supply follows the following sequence:

(a) disconnection of the load center from the hot conductor of the alternate power supply.

(b) disconnection of the load center from the neutral conductor of the alternate power supply;

(c) connection of the load center to the neutral conductor of the utility power supply; and (d) connection of the load center to the hot conductor of the utility power supply.

9. An electrical load center comprising:

a main switch electrically connected between a utility power supply and a power distribution member;

an alternate power supply switch connected between an alternate power supply and the power distribution member;

a first neutral switch connected between the alternate power supply and a neutral conductor;

a second neutral switch connected between the power supply and the neutral conductor; and an interlock system constructed to prevent electrical connectivity through the main switch and the alternate power supply switch wherein the interlock system is further constructed to control connection of the first and second neutral switches to the neutral conductor based on a position of the alternate power supply switch.

10. The electrical load center of claim 9 wherein the interlock system includes:

a first interlock operable between the main switch and the first and second neutral switches;

an in-line interlock operable between the first neutral switch and the second neutral switch; and a second interlock operable between the first and second neutral switches and the alternate power supply switch.

11. The electrical load center of claim 10 wherein the first interlock is movable between a first position and a second position, wherein when in the first position, the first interlock allows the main switch to be thrown and when in the second position, the first interlock prevents the main switch from being thrown.

12. The electrical load center of claim 11 wherein the first interlock, when in the first position, prevents the first and the neutral switches from being thrown and in the second position, allows the neutral switches to be thrown.

13. The electrical load center of claim 10, wherein the second interlock is movable between a first position and a second position, wherein when in the first position, the second interlock prevents operation of the alternate power supply switch and when in the second position, the second interlock allows operation of the alternate power supply switch.

14. The electrical load center of claim 13 wherein the second interlock is not movable to the second position unless the first neutral switch has been thrown to an ON position.

15. An interlock system for a power management system that controls power to a load center normally powered by an utility power supply and powered by an alternate power supply during interruption of the utility power supply, wherein current to the load center from the utility power supply is fed through a main switch and wherein current to the load center from the alternate power supply is fed through an alternate power supply switch, the interlock system comprising:

a first interlock operable between the main switch and first and second neutral switches, the first neutral switch controlling connection of the load center to a neutral conductor of the utility power supply and the second neutral switch controlling connection of the load center to a neutral conductor of the alternate power supply;

an in-line interlock operable between the first neutral switch and the second neutral switch; and a second interlock operable between the first and second neutral switches and the alternate power supply switch.

* * * * *